United States Patent [19]

Mason

[11] Patent Number: 5,068,988

[45] Date of Patent: Dec. 3, 1991

[54] DOCUMENT SUPPORTING APPARATUS

[75] Inventor: Jack A. Mason, Frankenmuth, Mich.

[73] Assignee: Susan P. Mason, Frankenmuth, Mich.

[21] Appl. No.: 478,955

[22] Filed: Feb. 12, 1990

[51] Int. Cl.[5] ..... G09F 11/18

[52] U.S. Cl. ..... 40/514; 40/518; 40/904

[58] Field of Search ..... 40/5, 518, 506, 514, 40/317, 660, 904; 24/570

[56] References Cited

U.S. PATENT DOCUMENTS

| | | | |
|---|---|---|---|
| 120,570 | 11/1871 | Brown | 24/570 |
| 159,058 | 1/1875 | Adams | 40/518 |
| 446,021 | 2/1891 | Semple | 40/514 |
| 596,873 | 1/1898 | Guy | 40/317 X |
| 607,530 | 7/1898 | Taylor | 24/570 X |
| 901,035 | 10/1908 | Patton | 40/518 |
| 3,159,937 | 12/1964 | Barnes | 40/518 X |
| 4,090,315 | 5/1978 | Brown, Jr. et al. | 40/518 |
| 4,157,626 | 6/1979 | Bedinghaus | 40/904 X |
| 4,177,588 | 12/1979 | Gebhardt et al. | 40/518 X |
| 4,262,436 | 4/1981 | Clement | 40/518 |
| 4,646,453 | 3/1987 | Reinhart . | |

FOREIGN PATENT DOCUMENTS

| | | | |
|---|---|---|---|
| 811318 | 4/1959 | United Kingdom | 40/5 |

*Primary Examiner*—Laurie K. Cranmer
*Assistant Examiner*—J. Bonifanti
*Attorney, Agent, or Firm*—Learman & McCulloch

[57] ABSTRACT

Apparatus for supporting a flexible, rollable document comprises a pair of tubular members each of which has an axially extending slot therein which communicates with a cylindrical bore open at both of its ends and into which such document may be introduced in rolled form. The slot communicates with the bore along a line which is tangential to the inner surface of the bore.

14 Claims, 1 Drawing Sheet

DOCUMENT SUPPORTING APPARATUS

This invention relates to supporting apparatus for documents such as charts and drawings and more particularly to apparatus for holding a flexible, rollable document in such position as to maintain it in rolled condition until such time as it is desired to withdraw a portion of the document from the support for viewing.

BACKGROUND OF THE INVENTION

It is customary for certain kinds of documents, such as those used for marine navigation charts, drawings, and blue prints, to appear on large, flexible sheets of paper which may be rolled in tubular form or folded. Folding a chart or drawing is undesirable because the creases on which the document is folded often obliterate information through which the creases pass. Particularly is this true in those instances in which a chart or drawing is folded and unfolded numerous times over a period of months or years.

Maintaining a drawing or chart in rolled, tubular form is more desirable than folding it inasmuch as creases thus are not formed. However, when it is desired to use the drawing or chart it must be unrolled an amount sufficient to enable the desired area of the document to be viewed, and sometimes this requires unrolling virtually the entire document. When such a document has been partially or completely unrolled, difficulty is encountered in maintaining it in its unrolled condition inasmuch as it has a tendency to return to its rolled condition. Further, such an unrolled document is susceptible to being torn, particularly if it is subjected to winds such as those prevalent in boating.

An object of the present invention is to overcome the disadvantages referred to above.

SUMMARY OF THE INVENTION

Document supporting apparatus constructed in accordance with the invention comprises a pair of tubular members each of which has a cylindrical wall defining a smooth, cylindrical bore that is open at both ends. The cylindrical wall of each of the tubular members has an axial slot therein extending the full length of such wall, the slot being in communication with the associated bore along a line which is non-radial with respect to the longitudinal axis of such member. The document may be introduced into the bore of each tubular member via its associated slot, and the bore of each member is of such diameter as to enable the entire document to be coiled therein. Neither of the tubular members is connected to the other in any way, thereby enabling them to be moved relatively toward and away from one another so as to coil and uncoil, respectively, a portion of the document in each of the tubular members. Preferably, the cylindrical wall of each member has an opening or window therein so as to enable the contents of the document adjacent the associated edge thereof to be viewed without necessitating complete removal of the document from the holder.

THE DRAWINGS

Apparatus constructed in accordance with the invention is illustrated in the accompanying drawings, wherein.

THE PREFERRED EMBODIMENT

Apparatus constructed in accordance with the preferred embodiment of the invention comprises a pair of tubular members 1 each of which is identical and has an annular side wall 2 encircling a smooth, unoccupied cylindrical bore 3. The member 1 is open at both of its ends.

Figure 3:
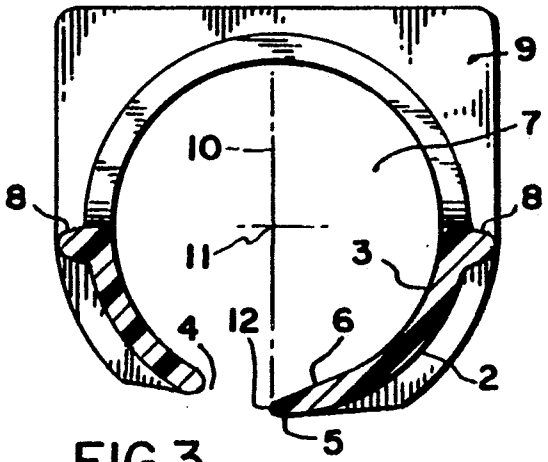
FIG. 3 is an enlarged sectional view taken on the line 3—3 of FIG. 2.

The side wall 2 of each tubular member is provided with an axial slot 4 which preferably extends the full length of the member. As is best shown in FIG. 3, the slot 4 communicates with the interior of the member via a flat surface 6 which is not radial, but instead, merges smoothly with the surface of the bore 3.

A portion of the wall 2 of each member 1 is relieved to provide an axially elongate window 7 which is circumferentially spaced from and diametrically opposite to the slot 4. The length of the window may vary, but it should be as long as possible without unduly weakening the member in which the window is formed. For example, if the member has a length of eighteen inches the window may be fourteen inches in length so as to leave an unbroken annular wall two inches in length at each end of the member.

Preferably, the window 7 is bordered at its opposite sides by longitudinally extending, stabilizing ribs 8 which merge at their opposite ends with radially projecting ribs or flanges 9. The ribs and flanges provide rigidity for each tubular member and minimize any tendency thereof to roll along a surface on which it may be laid.

Each member 1 preferably is formed from a buoyant material, such as polyvinylchloride, thereby enabling retrieval of a member which inadvertently may be dropped overboard.

The diameter of the bore 3 should be of such dimension as to enable the entire document to be rolled within a single member. The wall thickness of each member may vary, but a thickness of 0.15 inch has proven to be satisfactory for use with Great Lakes marine charts. The circumferential length of the window 7 conveniently can be 180°. The width of the slot 4 may be 0.30 inch and the angle of the surface 6 is 67° to a vertical plane 10 passing through the longitudinal axis 11 of the member and touching the tip 12 of the wall 2 adjacent the slot 4.

In use, a flat document 13, such as a marine chart, a drawing, a blueprint, or other sheet of flexible, coilable paper or other suitable material may have one of its edges 14 inserted in one of the members 1 via its slot 4. Because the slot communicates with the bore along a flat surface which merges smoothly with the surface of the bore, movement of the document into the member will cause the latter to be rolled or coiled within the member. The opposite edge 15 of the document 10 may be introduced into the bore of the other member 1 and rolled or coiled therein. For best results the members 1 should be parallel and so oriented that projections 5 of the flat surfaces 6 along which the slots communicate with their respective bores diverge upwardly, as viewed in FIG. 4.

Figure 1:
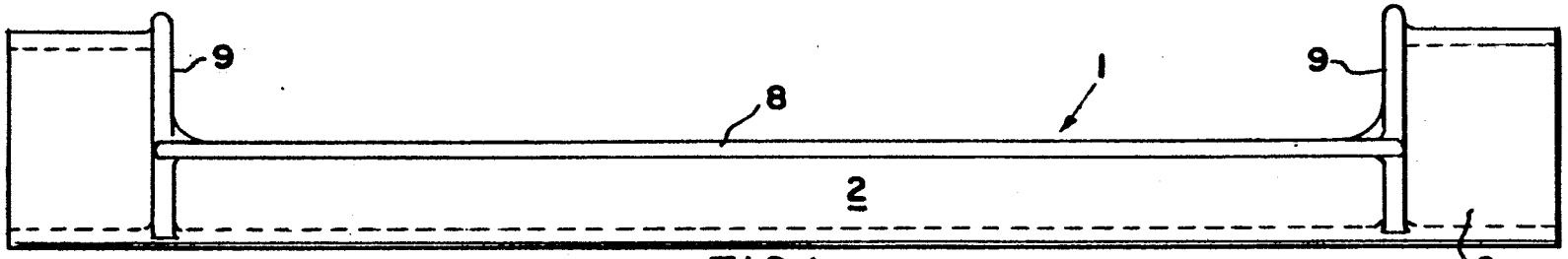
FIG. 1 is a side elevational view of one tubular member.
Figure 2:
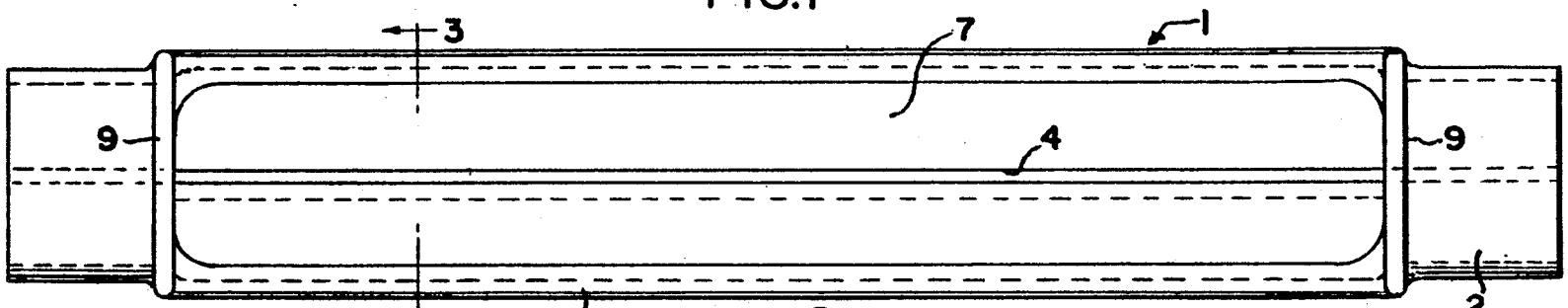
FIG. 2 is a top plan view of the member shown in FIG. 1.
Figure 4:
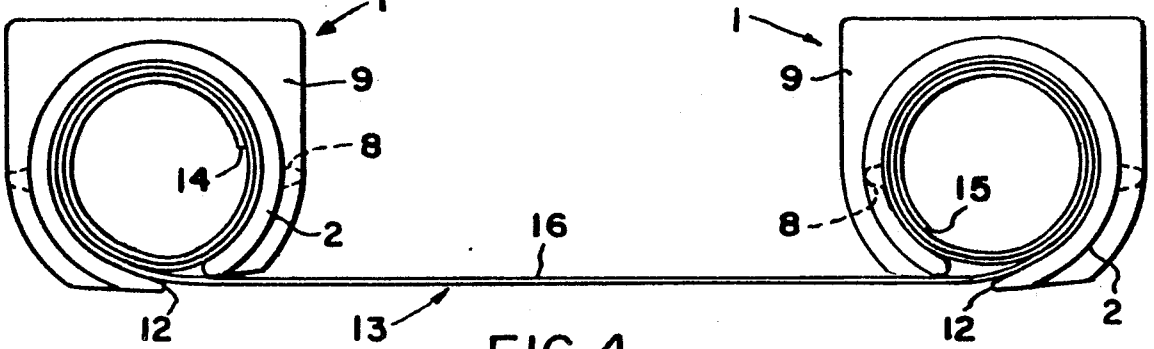
FIG. 4 is an end elevational view, on a reduced scale, of a pair of tubular members in which a document is rolled, the tubular members being spaced from one another so as to enable that part of the document therebetween to be viewed.

Since the members 1 are independent of each other, they may be moved toward and away from one another so as to enable the rolled portion of the document within each member to be increased or decreased, as desired. As shown in FIG. 4, the members 1 are spaced apart from one another a distance to expose an intermediate portion or web 16 of the document 13. It is possible, however, to move the members 1 toward one another from the position shown in FIG. 4 so that they engage each other, thereby restricting the overall size of the combined document and support members 1.

Some charts and documents contain data adjacent the marginal edges which sometimes requires visual inspection. Supports of the kind disclosed herein enable enough of the document to be unrolled from either support to permit such data to be viewed through the window 7, without necessarily requiring complete removal of the document from such support. Since the slot 4 in each member extends the full length thereof, each member can be slid along the length of the document to a location at which the marginal data can be viewed.

It is not necessary that either or both of the members 1 be retained with a document. Either or both of the members may be removed from a document when it no longer is required for use, thereby enabling such members to be transferred to another document. It is not necessary to unroll a document from a support member to separate a document from the member. The member simply may be slid longitudinally of its length until the document clears the bore.

This disclosure is representative of a presently preferred embodiment of the invention, but is intended to be illustrative rather than definitive thereof. The invention is defined in the claims.

What is claimed is:

1. Apparatus for supporting a flexible, coilable document, said apparatus comprising a single tubular member having an annular wall encircling a cylindrical, unoccupied bore having a smooth surface, said tubular member being open at both ends thereof, said annular wall of said member having an axial slot therein extending longitudinally of said wall the full length of said member and said wall having a portion thereof cut away between the ends of said member to form a window, said slot being of such width as to enable one edge of said document to pass through said slot into said bore whereupon said document is coilable within said member, said bore being of such diameter as to enable the entire document to be coiled therein.

2. The apparatus according to claim 1 wherein said window is circumferentially spaced from said slot.

3. The apparatus according to claim 2 wherein said window is bordered by projecting ribs.

4. The apparatus according to claim 3 including radially projecting flanges carried by said member adjacent opposite ends of said window.

5. A document and support combination comprising a pair of substantially uniform size tubular members each of which has an annular wall encircling a cylindrical bore having a smooth surface, each of said members having an axial slot therein extending the full length of such member and being in communication with the bore thereof, said members being substantially parallel to one another, said document comprising a multi-edge, flexible, coilable sheet having one edge thereof extending through the slot in one of said members and an opposite edge extending through the slot in the other of said members, each of said one and opposite edges of said sheet being freely movable relative to the respective members, each of said bores being open at both of its ends and unoccupied except for a portion of said sheet, said members being wholly independent of one another whereby relative movement of said members toward and away from each other enables said sheet respectively to be coiled in and uncoiled from the respective bores of said members.

6. The combination according to claim 5 wherein said one and said opposite edges of said sheet are greater in length than the length of said members.

7. The combination according to claim 5 wherein the bore of each of said members is of such diameter as to accommodate substantially the entire sheet therein when said sheet is coiled.

8. The combination according to claim 5 wherein the slot in each of said members includes a side having a flat surface which merges smoothly with the surface of such bore.

9. The combination according to claim 8 wherein said flat surface is non-radial with respect to the longitudinal axis of such bore.

10. The combination according to claim 5 wherein each of said members is cut away between its ends to form a window.

11. The apparatus according to claim 10 wherein said window is circumferentially spaced from said slot.

12. The apparatus according to claim 10 wherein said window is bordered by projecting ribs extending longitudinally of said member.

13. The apparatus according to claim 10 wherein said window is bordered at its opposite ends by outwardly projecting flanges.

14. The apparatus according to claim 10 including stabilizing ribs bordering all edges of said window.

* * * * *

UNITED STATES PATENT AND TRADEMARK OFFICE

CERTIFICATE OF CORRECTION

PATENT NO. : 5,068,988

DATED : December 3, 1991

INVENTOR(S) : Jack A. Mason

It is certified that error appears in the above-identified patent and that said Letters Patent is hereby corrected as shown below:

Column 3, line 49, after "and" insert -- communicating with said bore --.

Signed and Sealed this

Ninth Day of March, 1993

*Attest:*

STEPHEN G. KUNIN

*Attesting Officer*

*Acting Commissioner of Patents and Trademarks*